US009792853B2

(12) United States Patent
Jeon

(10) Patent No.: US 9,792,853 B2
(45) Date of Patent: Oct. 17, 2017

(54) PIXEL, DRIVING METHOD OF PIXEL, AND DISPLAY DEVICE INCLUDING PIXEL

(71) Applicant: SAMSUNG DISPLAY CO., LTD., Yongin, Gyeonggi-Do (KR)

(72) Inventor: Jin Jeon, Yongin (KR)

(73) Assignee: Samsung Display Co., Ltd., Yongin, Gyunggi-do (KR)

( * ) Notice: Subject to any disclaimer, the term of this patent is extended or adjusted under 35 U.S.C. 154(b) by 86 days.

(21) Appl. No.: 14/310,042

(22) Filed: Jun. 20, 2014

(65) Prior Publication Data

US 2015/0054812 A1 Feb. 26, 2015

(30) Foreign Application Priority Data

Aug. 22, 2013 (KR) ..... 10-2013-0099933

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0205* (2013.01); *G09G 2310/0216* (2013.01); *G09G 2310/0262* (2013.01); *G09G 2320/0252* (2013.01); *G09G 2320/0257* (2013.01)

(58) Field of Classification Search
None
See application file for complete search history.

(56) References Cited

U.S. PATENT DOCUMENTS

2006/0267884 A1* 11/2006 Takahashi ..... G09G 3/3233 345/76
2011/0074757 A1* 3/2011 Chung ..... G09G 3/3233 345/211
2011/0141000 A1* 6/2011 Han ..... G09G 3/3233 345/82
2012/0001893 A1* 1/2012 Jeong ..... G09G 3/3233 345/213
2012/0019504 A1* 1/2012 Han ..... G09G 3/3233 345/212
2012/0147060 A1* 6/2012 Jeong ..... G09G 3/3233 345/690

FOREIGN PATENT DOCUMENTS

KR 10-0865396 B1 10/2008
KR 10-2010-0009219 A 1/2010
KR 10-1152466 B1 5/2012
KR 10-1152580 B1 5/2012
KR 10-2012-0065137 A 6/2012

* cited by examiner

*Primary Examiner* — Seokyun Moon
*Assistant Examiner* — Douglas Wilson
(74) *Attorney, Agent, or Firm* — Lee & Morse, P.C.

(57) ABSTRACT

A pixel includes a driving transistor connected to an organic light emitting diode. The circuit places the driving transistor in an on-biased state based on first and second scan signals which at least partially overlap during a time when an organic light emitting diode does not emit light. The first and scan signals are received from different scan lines. The scan lines may be adjacent scan lines.

21 Claims, 6 Drawing Sheets

PIXEL, DRIVING METHOD OF PIXEL, AND DISPLAY DEVICE INCLUDING PIXEL

CROSS-REFERENCE TO RELATED APPLICATION

Korean Patent Application No. 10-2013-0099933, filed on Aug. 22, 2013, and entitled, "Pixel, Driving Method Of Pixel, and Display Device Including Pixel," is incorporated by reference herein in its entirety.

BACKGROUND

1. Field

One or more embodiments described herein relate to a display device.

2. Description of the Related Art

In an organic light emitting diode (OLED) display device, a driving circuit controls the current to organic light emitting diodes of each pixel to emit light. One type of driving circuit includes at least two transistors and one capacitor. In operation, hysteresis may cause a voltage written in a driving circuit in a previous frame to affect the voltage written to the driving circuit in a next frame. Also, hysteresis may cause variations in pixel luminance when changing between gray scale values in the previous and next frames. In other words, the response speed for changing pixel luminance between frames may deteriorate over time. Also, an echo phenomenon or shadow phenomenon may occur during, for example, a text scroll operation.

SUMMARY

In accordance with one embodiment, a pixel includes an organic light emitting diode, a switching transistor to switch a data signal based on a first scanning signal; a driving transistor to control a driving current to be supplied to the organic light emitting diode based on the data signal; a first transistor to transfer an initialization voltage to a gate of the driving transistor depending on a second scanning signal; and a second transistor to transfer the initialization voltage to the organic light emitting diode depending on the first scanning signal, wherein the first scanning signal is after the second scanning signal and wherein enable periods of the first and second scanning signals at least partially overlap.

The pixel may further include a third transistor having first and second terminals connected between the gate and a drain of the driving transistor, the third transistor to perform a switching operation depending on the first scanning signal; and a capacitor connected between the gate of the driving transistor and a first power supply voltage. A gate of the switching transistor and a gate of the third transistor may be connected to receive the first scanning signal, one terminal of the switching transistor may be connected to a data line of the data signal, and another terminal of the switching transistor may be connected to a source of the driving transistor.

The pixel may further include a fourth transistor connected between the anode of the organic light emitting diode and the driving transistor; and a fifth transistor connected between the source of the driving transistor and the first power supply voltage. The gate of the switching transistor may be connected to the first scanning signal, one terminal of the switching transistor may be connected to a data line of the data signal, and another terminal of the switching transistor may be connected to the source of the driving transistor. A gate of the fourth transistor and a gate of the fifth transistor may be connected to a light emitting control line of a light emitting signal, and a disable period of the light emitting signal may overlap the enable periods of the first and second scanning signals.

In accordance with another embodiment, a display device includes a plurality of pixels and a plurality of data lines, a plurality of scanning lines, and a plurality of light emitting control lines, wherein each pixel is connected to a corresponding one of the data lines, two scanning lines, and a corresponding one of the light emitting control lines. Each pixel includes an organic light emitting diode; a switching transistor to switch a data signal based on a first scanning signal; a driving transistor to control a driving current to be supplied to the organic light emitting diode based on the data signal; a first transistor to transfer an initialization voltage to a gate of the driving transistor depending on a second scanning signal; and a second transistor to transfer the initialization voltage to the organic light emitting diode depending on the first scanning signal, wherein the first scanning signal is after the second scanning signal and wherein at least one enable period of the first scanning signal and at least one enable period of the second scanning signal at least partially overlap.

The at least one enable period of the first scanning signal and the at least one enable period of the second scanning signal may completely overlap or at least substantially so. The first scanning signal may have first and second consecutive enable periods, the second scanning signal may have third and fourth consecutive enable periods, and the second and third enable periods may at least partially overlap. The second and third enable periods may completely overlap.

Each pixel may include a third transistor having two terminals connected between the gate and a drain of the driving transistor and a gate connected to the first scanning line; and a capacitor connected between the gate of the driving transistor and a first power supply voltage.

Each pixel may include a fourth transistor connected between an anode of the organic light emitting diode and a drain of the driving transistor; and a fifth transistor connected between a source of the driving transistor and a first power supply voltage. A gate of the fourth transistor and a gate of the fifth transistor are connected to a corresponding one of the light emitting control lines of a light emitting signal, and a disable period of the light emitting signal includes the at least one enable period of the first scanning signal and the at least one enable period of the second scanning signal.

In accordance with another embodiment, a method for driving a pixel includes turning on a first transistor based on a first scanning signal; turning on a switching transistor based on a second scanning signal; turning on a second transistor connected between a gate and a drain of a driving transistor based on the second scanning signal; and on-biasing the driving transistor through a signal path which includes the switching transistor, the driving transistor, the second transistor, and the first transistor, the driving transistor on-biased for a period during which the first transistor and the switching transistor are simultaneously turned on. The first scanning signal may be enabled earlier than the second scanning signal.

The method may further include writing a voltage to a capacitor during a period in which the switching transistor and second transistor are turned on, wherein the voltage is based on a difference between a threshold voltage of the driving transistor and a data voltage coupled to the gate of the driving transistor.

The method may further include turning on a third transistor connected between the driving transistor and the organic light emitting diode based on a light emitting signal, wherein the light emitting signal is disabled for an enable period of the first scanning signal and the second scanning signal. The method may include turning on a fourth transistor connected between the driving transistor and a power supply voltage based on the light emitting signal.

In accordance with another embodiment, a pixel includes a driving transistor; and a circuit connected to the driving transistor, wherein the circuit is to place the driving transistor in an on-biased state based on first and second scan signals which at least partially overlap during a time when an organic light emitting diode connected to the driving transistor does not emit light. The first and second scan signals are received from different scan lines.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
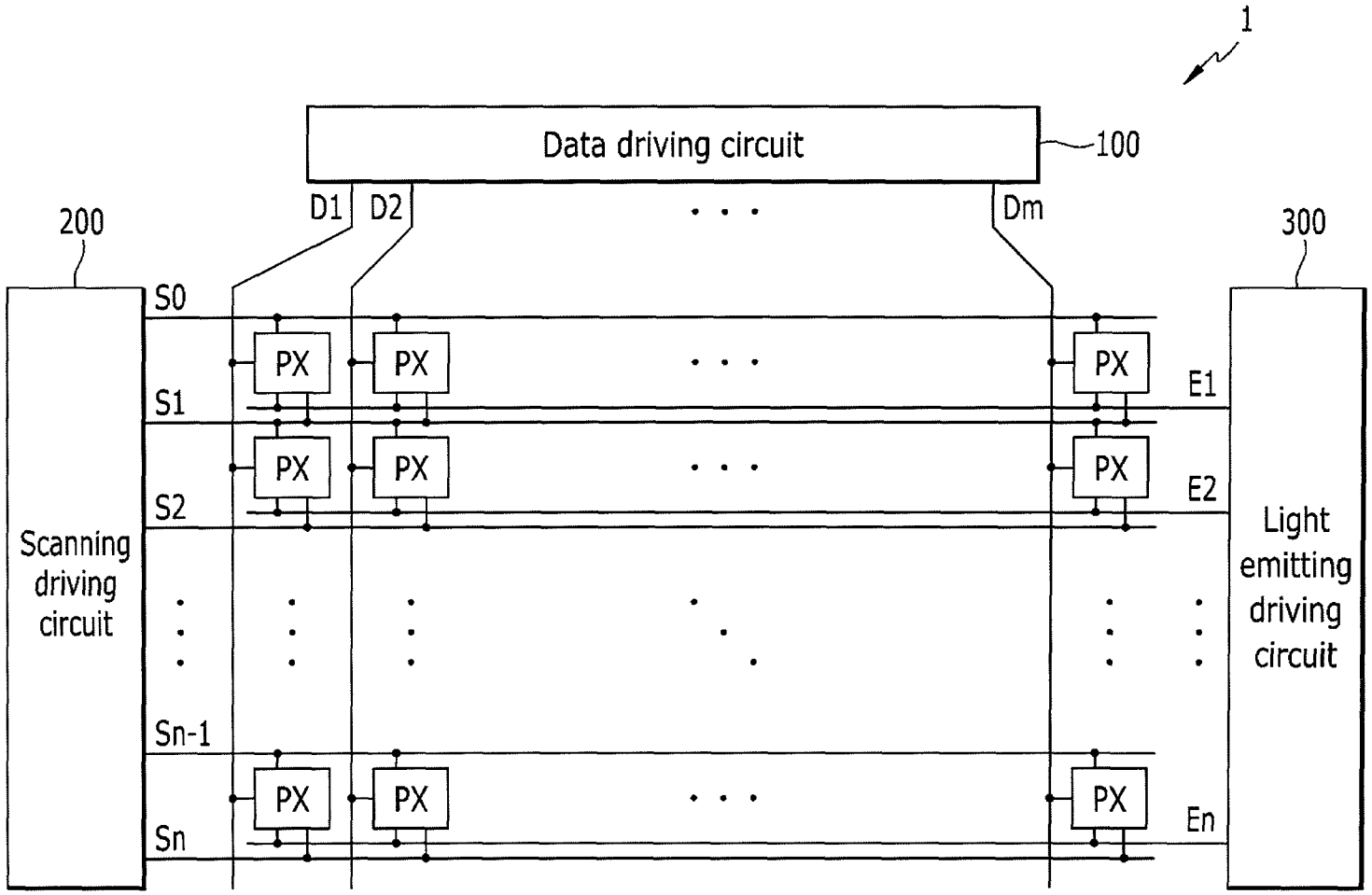
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 1 which includes a scanning driving circuit 100, a data driving circuit 200, a light emitting driving circuit 300, a plurality of scanning lines S0 to Sn, a plurality of light emitting control lines E1 to En, a plurality of data lines D1 to Dm, and a plurality of pixels PXs.

The scanning lines S0 to Sn are arranged vertically and extend horizontally. The light emitting control lines E1 to En are arranged vertically and extend horizontally. The data lines D1 to Dm are arranged horizontally direction and extend vertically. Each of the pixels PXs is connected to two scanning lines, one light emitting control line, and one data line.

The scanning driving circuit 100 supplies scanning signals S[0] to S[n] to respective ones of the scanning lines S0 to Sn. The light emitting driving circuit 300 supplies light emitting signals EM[1] to EM[n] to respective ones of the light emitting control lines E1 to En. The data driving circuit 200 generates data signals (for example, data voltages) depending on input image data and supplies the data signals to respective ones of the data lines D1 to Dm.

In operation, each pixel PX may be initialized depending on a scanning signal supplied through one of the two corresponding scanning lines. Each pixel PX receives a data signal from a corresponding data line. The data signal may be synchronized with a scanning signal supplied through the other of the two corresponding scanning lines. The pixel PX is written with the data signal. A driving current, which depends on the written data signal, is supplied to an organic light emitting diode (a light emitting device of the pixel PX) depending on the corresponding light emitting signal.

Figure 2:
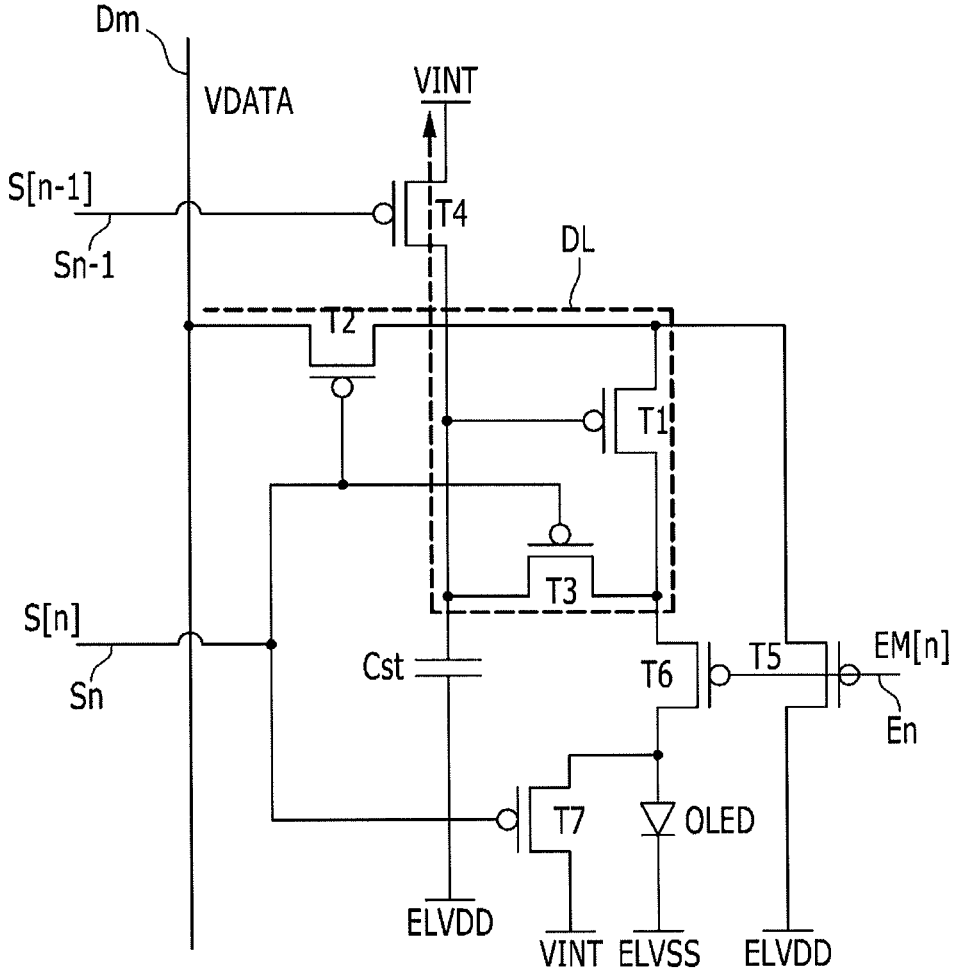
FIG. 2 illustrates an embodiment of a pixel in the display device.

FIG. 2 illustrates an embodiment of a pixel PX which may be included in the display device. As illustrated in FIG. 2, the pixel PX is connected to an i−1-th scanning line, an i-th scanning line, an i-th light emitting control line, and an m-th data line.

As further illustrated in FIG. 2, pixel PX includes seven transistors T1 to T7 and one capacitor Cst. Power supply voltages ELVDD and ELVSS are set to be at levels to operate the pixel PX. For example, power supply voltage ELVDD may be a voltage higher than power supply voltage ELVSS, and a difference between these voltages may be set to be at least predetermined level or more. An initialization voltage VINT may be set to be a voltage of a level which initializes the pixel PX.

Switching transistor T2 includes one terminal connected to data line Dm and another terminal connected to a source of the driving transistor T1. A gate of switching transistor T2 is connected to the scanning line Sn.

Transistor T4 includes one terminal connected to the initialization voltage VINT, a gate connected to the scanning line Sn-1, and another terminal connected to a gate of the driving transistor T1.

Transistor T3 includes terminals connected between the gate and a drain of the driving transistor T1, and a gate connected to the scanning line Sn.

Transistor T7 includes one terminal connected to the initialization voltage, a gate connected to the scanning line Sn, and another terminal connected to an anode of the organic light emitting diode (OLED).

Transistor T6 includes one terminal connected to the drain of the driving transistor T1, another terminal connected to the anode of the organic light emitting diode (OLED), and a gate connected to the light emitting control line En.

Transistor T5 includes one terminal connected to the source of the driving transistor T1, another terminal connected to the power supply voltage ELVDD, and the gate connected to the light emitting control line En.

The driving transistor T1 includes a source connected to terminals of switching transistor T2 and transistor T5, a drain connected to terminals of transistors T3 and T6, and a gate connected to terminals of switching transistor T2 and transistor T3.

The capacitor Cst is connected between the gate of the driving transistor T3 and power supply voltage ELVDD. A cathode of the organic light emitting diode (OLED) is connected to power supply voltage ELVSS.

A scanning signal S[n-1] is transferred through scanning line Sn-1, scanning signal S[n] is transferred through scanning line Sn, and light emitting signal EM[n] is transferred through light emitting control line En. Although the transistors are shown to be PMOS transistors, in alternative embodiments the transistors may be NMOS transistors or a combination of PMOS and NMOS transistors.

Figure 3:
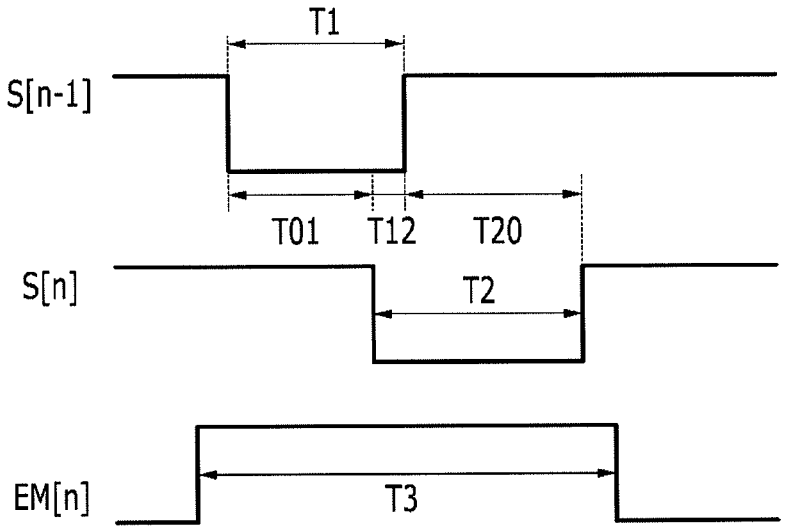
FIG. 3 illustrates an embodiment of waveforms for controlling the pixel.

FIG. 3 illustrates an embodiment of waveforms that may be used to control the pixel. As illustrated in FIG. 3, scanning signal S[n-1] is at low level for a period T1, scanning signal S[n] is at a low level for a period T2, and light emitting signal EM[n] is at a high level for a period T3. In one example embodiment, period T3 may have a starting time that corresponds to or is before a starting time of period T1 and may have an ending time that corresponds to or is after an ending time of period T2. Period T12 corresponds to a period during which T1 and T2 overlap and may be between a starting time of period T1 and an ending time of T2. The remaining period of period T1 excluding period T12 is set to be T01, and the remaining period of period T2 excluding period T12 is set to be T20.

Transistors T5 and T6 are turned off by the light emitting signal EM[n] of a high level for the period T3. Therefore, the organic light emitting diode (OLED) does not emit light during period T3.

Transistor T4 is turned on by scanning signal S[n-1] of a low level during the T01 period. As a result, initialization voltage VINT is connected to a gate electrode of the driving transistor T1.

When scanning signal S[n] goes to a low level in period T12, transistors T2, T3, and T7 turn on. Because transistor T4 is also in a turn-on state in period T12, a current path is formed that follows dotted line DL in FIG. 2. The driving transistor T1 is on-biased along the current path, thereby reducing or minimizing hysteresis.

Transistor T4 is turned off at a starting time of the period T20, that is, a time at which scanning signal S[n-1] rises to a high level. Then, the data signal (for example, data voltage VDATA) transferred through data line Dm based on the turned on state of transistor T2 is connected to the source of driving transistor T1.

The gate and drain of the driving transistor T1 are diode-connected based on the turned on state of transistor T3, and the gate of driving transistor T1 is applied with a voltage VDATA+Vth. Because Vth is a negative voltage, voltage VDATA is reduced by the threshold voltage of driving transistor T1. Next, capacitor Cst is charged with a voltage difference ELVDD−(VDATA+Vth) between power supply voltage ELVDD and voltage VDATA+Vth.

The anode of the organic light emitting diode (OLED) is connected to initialization voltage VINT as a result of the turned on state of transistor T7 during period T2.

After period T3, when light emitting signal EM[n] is at a low level, transistors T5 and T6 are turned on. Then, the source of driving transistor T1 is connected to power supply voltage ELVDD and the drain of driving transistor T1 is connected to the cathode of the organic light emitting diode (OLED).

Also, after period T3, a source-gate voltage of the driving transistor T1 becomes ELVDD−(ELVDD−(VDATA+Vth)), that is, VDATA+VTH. The driving current flowing in driving transistor T1 depends on a square of ((source-gate voltage)−(threshold voltage)). When the VTH is subtracted from the source-gate voltage VDATA+VTH, only the data voltage VDATA remains. Therefore, the threshold voltage deviation may be compensated.

As a result, the corresponding driving transistor (for example, T1) is on-biased for a period (for example, T12) in which enable periods (for example, a period of a low level) of the two adjacent scanning signals (for example, S[n-1] and S[n]) overlap each other. Then, hysteresis may be reduced or even minimized and response speed may be improved.

Figure 4:
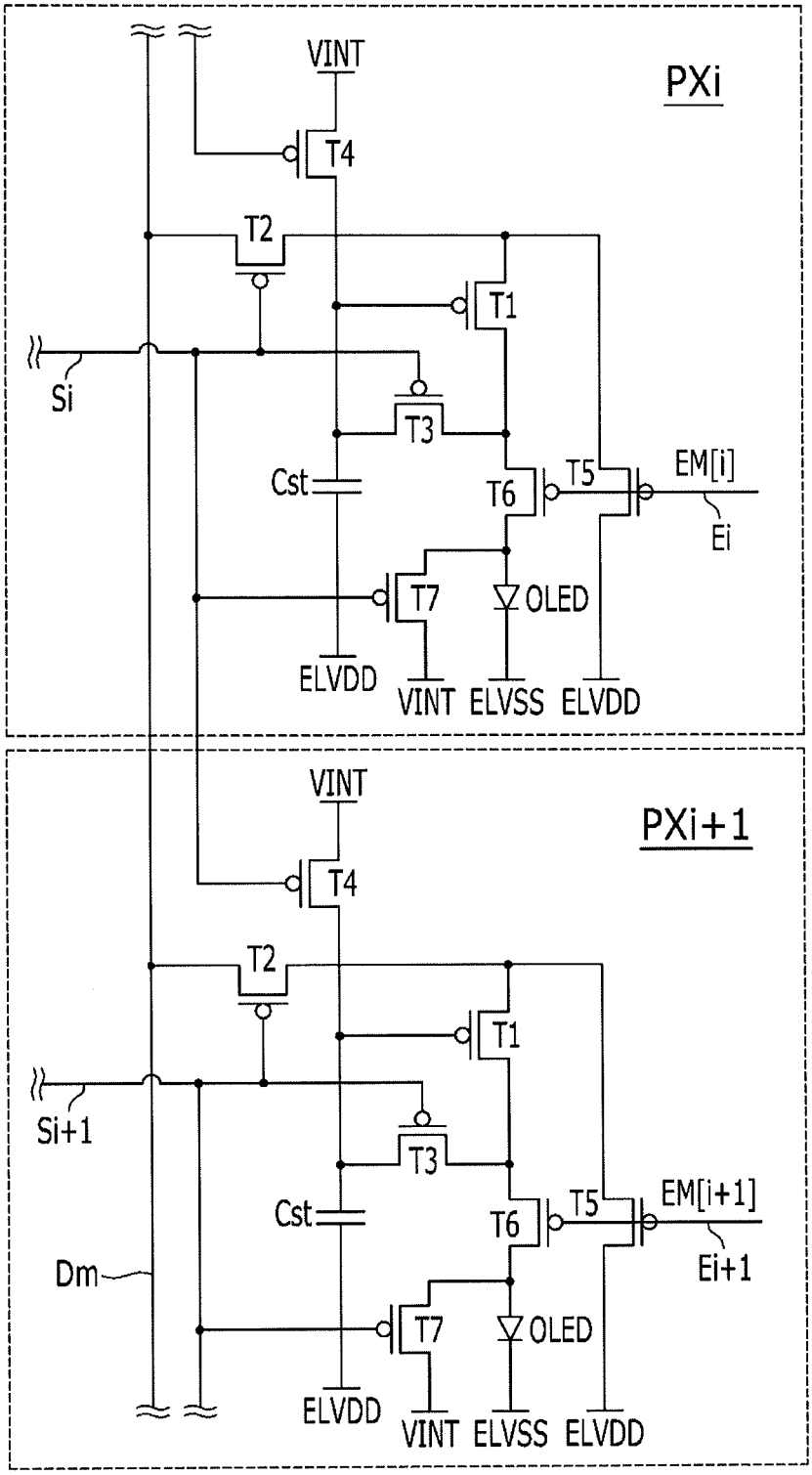
FIG. 4 illustrates an example of two pixels that are arranged vertically.

FIG. 4 illustrates an embodiment of two vertically arranged pixels which, for example, may be included in the display device in FIG. 1. In this embodiment, the i-th pixel PXi and the i+1-th pixel PXi+1 are arranged vertically. According to one embodiment, the pixels may be configured in a manner similar to that shown in FIG. 2.

As illustrated in FIG. 4, scanning line Si is connected to the gates of the transistors T2, T3, and T7 of pixel PXi and transistor T4 of the next row pixel PXi+1. The pixel PXi is adjacent to the pixel PXi+1, and the two adjacent pixels share one scanning line Si and therefore do not require an additional scanning line. Scanning line Si+1 is also shared by pixel PXi+1 and a row pixel in a next row. That is, scanning line Si+1 is connected to gates of the transistors T2, T3, and T7 of pixel PXi+1 and transistor T4 of next-row pixel PXi+2.

The waveform of the scanning signals in FIG. 3 may be used to operate the pixels in FIG. 4. However, in other embodiments, one or more different scanning signals that at least partially overlap may be used.

Figure 5:
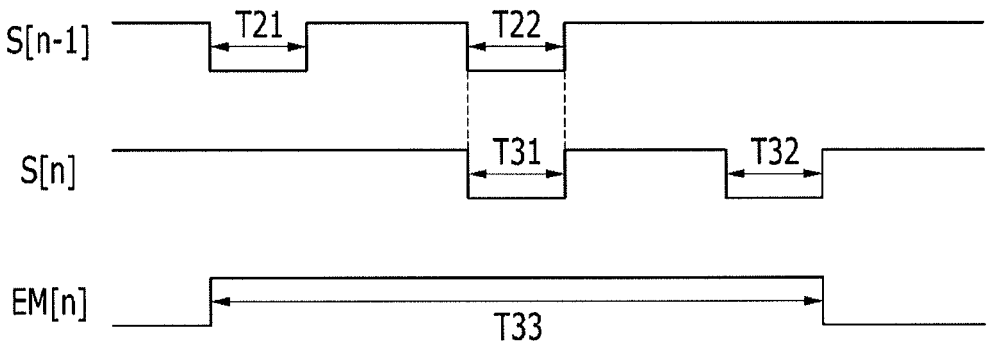
FIG. 5 illustrates another embodiment of waveforms for controlling a pixel.

FIG. 5 illustrates another embodiment of scanning signal waveforms that may be used to control one or more pixels. As illustrated in FIG. 5, scanning signal S[n-1] is at a low level in periods T21 and T22 and scanning signal S[n] is at a low level in periods T31 and T32. In this case, periods T22 and T31 overlap each other. Also, overlapping periods T22 and T31 may be periods of the same duration.

Figure 6:
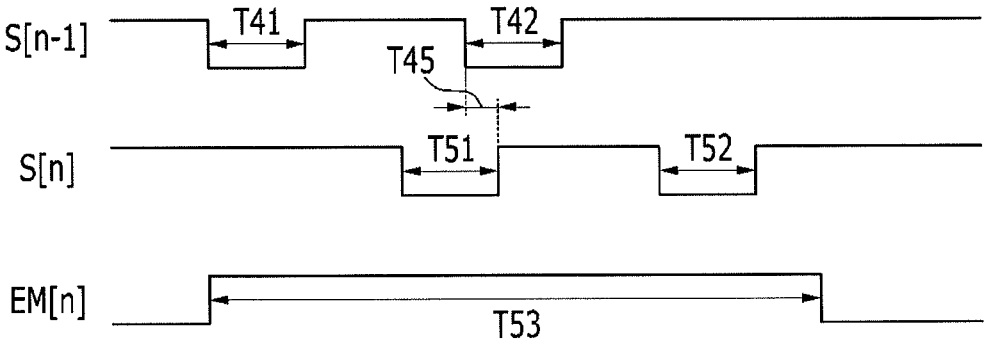
FIG. 6 illustrates another embodiment of waveforms for controlling a pixel.

FIG. 6 illustrates another embodiment of scanning signal waveforms that may be used to control one or more pixels. As illustrated in FIG. 6, a period T42 of a second low level of scanning signal S[n-1] and a period T51 of a first low level of scanning signal S[n] may partially overlap each other in a period T45.

In FIGS. 5 and 6, light emitting signal EM(n) is at a high level for periods T33 and T53 to block light emission. Period T33 may include an ending time which corresponds to or is after an ending time of period T32 and a starting time which is before or corresponds to a starting time of period T21. Period T53 may have an ending time which comes after an ending time of period T52 and a starting time which corresponds to or is before a starting time of a period T41.

Operation during the overlapping period T22 (or T31) in FIG. 5 and operation during overlapping period T45 in FIG. 6 may be the same as in period T12 as previously described. That is, the driving transistor may be on-biased during these overlapping periods, to thereby reduce or minimize hysteresis.

In the foregoing embodiments, scanning lines S[n-1] and S[n] are adjacent scan lines. However, when the scanning lines are driven in an interleaved manner, the scanning lines which are to have at least partially overlapping enable periods may be consecutive or non-consecutive (e.g., even scan lines or odd scan lines).

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel, comprising:

an organic light emitting diode;

a switching transistor to switch a data signal based on a first scanning signal;

a driving transistor to control a driving current to be supplied to the organic light emitting diode based on the data signal;

a first transistor to transfer an initialization voltage to a gate of the driving transistor depending on a second scanning signal; and a second transistor to transfer the initialization voltage to the organic light emitting diode depending on the first scanning signal, wherein the first scanning signal is after the second scanning signal and wherein enable periods of the first and second scanning signals at least partially overlap to establish a current path through the switching transistor, the driving transistor, and the first transistor.

2. A pixel, comprising:

an organic light emitting diode;

a switching transistor to switch a data signal based on a first scanning signal;

a driving transistor to control a driving current to be supplied to the organic light emitting diode based on the data signal;

a first transistor to transfer an initialization voltage to a gate of the driving transistor depending on a second scanning signal;

a second transistor to transfer the initialization voltage to the organic light emitting diode depending on the first scanning signal, wherein the first scanning signal is after the second scanning signal and wherein enable periods of the first and second scanning signals at least partially overlap;

a third transistor having first and second terminals connected between the gate and a drain of the driving transistor, the third transistor to perform a switching operation depending on the first scanning signal; and a capacitor connected between the gate of the driving transistor and a first power supply voltage.

3. The pixel as claimed in claim 2, wherein:

a gate of the switching transistor and a gate of the third transistor are connected to receive the first scanning signal, one terminal of the switching transistor is connected to a data line of the data signal, and another terminal of the switching transistor is connected to a source of the driving transistor.

4. The pixel as claimed in claim 1, further comprising:

a fourth transistor connected between the anode of the organic light emitting diode and the driving transistor; and a fifth transistor connected between the source of the driving transistor and the first power supply voltage.

5. The pixel as claimed in claim 4, wherein:

the gate of the switching transistor is connected to receive the first scanning signal, one terminal of the switching transistor is connected to a data line of the data signal, and another terminal of the switching transistor is connected to the source of the driving transistor.

6. The pixel as claimed in claim 4, wherein:

a gate of the fourth transistor and a gate of the fifth transistor are connected to a light emitting control line of a light emitting signal, and a disable period of the light emitting signal overlaps the enable periods of the first and second scanning signals.

7. A display device, comprising:

a plurality of pixels; and a plurality of data lines, a plurality of scanning lines, and a plurality of light emitting control lines, wherein each pixel is connected to a corresponding one of the data lines, two scanning lines, and a corresponding one of the light emitting control lines, each pixel including:

an organic light emitting diode;

a switching transistor to switch a data signal based on a first scanning signal;

a driving transistor to control a driving current to be supplied to the organic light emitting diode based on the data signal;

a first transistor to transfer an initialization voltage to a gate of the driving transistor depending on a second scanning signal; and a second transistor to transfer the initialization voltage to the organic light emitting diode depending on the first scanning signal, wherein the first scanning signal is after the second scanning signal and wherein at least one enable period of the first scanning signal and at least one enable period of the second scanning signal at least partially overlap to establish a current path through the switching transistor, the driving transistor, and the first transistor.

8. The display device as claimed in claim 7, wherein the at least one enable period of the first scanning signal and the at least one enable period of the second scanning signal completely overlap.

9. The display device as claimed in claim 7, wherein:

the first scanning signal has first and second consecutive enable periods, the second scanning signal has third and fourth consecutive enable periods, and the second and third enable periods at least partially overlap.

10. The display device as claimed in claim 9, wherein the second and third enable periods completely overlap.

11. The display device as claimed in claim 7, wherein each pixel comprises:

a third transistor having two terminals connected between the gate and a drain of the driving transistor and a gate connected to the first scanning line; and a capacitor connected between the gate of the driving transistor and a first power supply voltage.

12. The display device as claimed in claim 7, wherein each pixel comprises:

a fourth transistor connected between an anode of the organic light emitting diode and a drain of the driving transistor; and a fifth transistor connected between a source of the driving transistor and a first power supply voltage.

13. The display device as claimed in claim 12, wherein:

a gate of the fourth transistor and a gate of the fifth transistor are connected to a corresponding one of the light emitting control lines of a light emitting signal, and a disable period of the light emitting signal includes the at least one enable period of the first scanning signal and the at least one enable period of the second scanning signal.

14. A method for driving a pixel including a driving transistor that controls a driving current of an organic light emitting diode, the method comprising:

turning on a first transistor based on a first scanning signal;

turning on a switching transistor based on a second scanning signal different from the first scanning signal;

turning on a second transistor connected between a gate and a drain of a driving transistor based on the second scanning signal; and on-biasing the driving transistor through a signal path which includes the switching transistor, the driving transistor, the second transistor, and the first transistor, the driving transistor on-biased for a period during which the first transistor and the switching transistor are simultaneously turned on.

15. A method for driving a pixel including a driving transistor that controls a driving current of an organic light emitting diode, the method comprising:

turning on a first transistor based on a first scanning signal;

turning on a switching transistor based on a second scanning signal;

turning on a second transistor connected between a gate and a drain of a driving transistor based on the second scanning signal; and on-biasing the driving transistor through a signal path which includes the switching transistor, the driving transistor, the second transistor, and the first transistor, the driving transistor on-biased for a period during which the first transistor and the switching transistor are simultaneously turned on, wherein the first scanning signal is enabled earlier than the second scanning signal.

16. The method as claimed in claim 14, further comprising:

writing a voltage to a capacitor during a period in which the switching transistor and second transistor are turned on, wherein the voltage is based on a difference between a threshold voltage of the driving transistor and a data voltage coupled to the gate of the driving transistor.

17. The method as claimed in claim 14, further comprising:

turning on a third transistor connected between the driving transistor and the organic light emitting diode based on a light emitting signal, wherein the light emitting signal is disabled for an enable period of the first scanning signal and the second scanning signal.

18. The method as claimed in claim 17, further comprising:

turning on a fourth transistor connected between the driving transistor and a power supply voltage based on the light emitting signal.

19. A pixel, comprising:

a driving transistor; and a circuit connected to the driving transistor, wherein the circuit is to place the driving transistor in an on-biased state based on first and second scan signals which at least partially overlap during a time when an organic light emitting diode connected to the driving transistor does not emit light, wherein the driving transistor is to output current to the organic light emitting diode to emit light, wherein a current path is established through the driving transistor when the first and second scan signals partially overlap, the current path coupled to an initialization voltage, and wherein an overlap period of enable periods of the first and second scan signals is less than an enable period of the first scan signal and an enable period of the second scan signal.

20. The pixel as claimed in claim 19, wherein the first and second scan signals are received from different scan lines.

21. The pixel as claimed in claim 1, wherein the current path is between a data line of the data signal and the initialization voltage.

* * * * *